US010640250B2

(12) United States Patent
Clusserath

(10) Patent No.: US 10,640,250 B2
(45) Date of Patent: May 5, 2020

(54) CONTAINER-TREATING MACHINE

(75) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 1147 days.

(21) Appl. No.: 14/342,037

(22) PCT Filed: Jun. 19, 2012

(86) PCT No.: PCT/EP2012/002575
§ 371 (c)(1),
(2), (4) Date: Feb. 28, 2014

(87) PCT Pub. No.: WO2013/029704
PCT Pub. Date: Mar. 7, 2013

(65) Prior Publication Data

US 2014/0215965 A1 Aug. 7, 2014

(30) Foreign Application Priority Data

Aug. 30, 2011 (DE) ..... 10 2011 111 483

(51) Int. Cl.
*B65B 55/24* (2006.01)
*B67C 3/28* (2006.01)
(Continued)

(52) U.S. Cl.
CPC ..... *B65B 55/24* (2013.01); *B65B 3/18* (2013.01); *B65B 3/30* (2013.01); *B65B 55/04* (2013.01);
(Continued)

(58) Field of Classification Search
CPC .. B65B 3/18; B65B 3/30; B65B 55/04; B65B 21/06; B67C 3/02; B67C 3/22;
(Continued)

(56) References Cited

U.S. PATENT DOCUMENTS 1,804,985 A * 5/1931 Hoffman ..... B67C 3/02 141/150
1,809,163 A * 6/1931 Enock ..... B67C 3/04 141/147
(Continued)

FOREIGN PATENT DOCUMENTS

DE 39 11 781 10/1990
DE 42 37 044 12/1993
(Continued)

*Primary Examiner* — Paul R Durand
*Assistant Examiner* — Randall A Gruby
(74) *Attorney, Agent, or Firm* — Occhiuti & Rohlicek LLP

(57) ABSTRACT

An apparatus for treating containers includes treatment positions arranged on a transport element with a rotor, a transport element, treatment blocks, and functional elements. The treatment positions are formed on the treatment blocks, with at least two per block. Each treatment position ha all functional elements required for treating a container. The functional elements can be for controlled relative movement between treatment blocks and containers, for control of controlled fluid paths for a fluid treatment medium, for monitoring the treatment process, a functional element for controlling the treatment process, or for actuating elements or drives. At least one common functional element needed for treatment of the containers is provided jointly for all treatment positions assigned to one treatment block.

18 Claims, 7 Drawing Sheets

(51) Int. Cl.

| | |
|---|---|
| ***B67C 3/02*** | (2006.01) |
| ***B67C 3/22*** | (2006.01) |
| ***B67C 3/26*** | (2006.01) |
| ***B65B 3/18*** | (2006.01) |
| ***B65B 3/30*** | (2006.01) |
| ***B65B 55/04*** | (2006.01) |

(52) U.S. Cl.
CPC ..... *B67C 3/02* (2013.01); *B67C 3/22* (2013.01); *B67C 3/2617* (2013.01); *B67C 3/28* (2013.01); *B67C 2003/2602* (2013.01); *B67C 2003/2685* (2013.01)

(58) Field of Classification Search
CPC ..... B67C 3/28; B67C 3/225; B67C 3/244; B67C 3/246; B67C 3/2617
See application file for complete search history.

(56) References Cited

U.S. PATENT DOCUMENTS

| | | | | |
|---|---|---|---|---|
| 1,919,665 | A * | 7/1933 | Muller | B67C 3/06 141/243 |
| 2,367,899 | A * | 1/1945 | Stewart | B67C 3/08 141/101 |
| 2,813,555 | A | 11/1957 | Fox et al. | |
| 3,037,536 | A * | 6/1962 | Fechheimer | B65B 3/26 141/116 |
| 3,047,032 | A * | 7/1962 | Carter | B67C 3/04 141/149 |
| 3,073,090 | A | 1/1963 | Cecil et al. | |
| 3,146,807 | A * | 9/1964 | Tatibana | B67C 3/02 141/230 |
| 4,259,999 | A * | 4/1981 | Wada | B67C 3/08 141/140 |
| 5,417,031 | A * | 5/1995 | Bankuty | B65B 7/2835 53/331.5 |
| 7,331,156 | B2 * | 2/2008 | Hartness | B65G 17/323 198/470.1 |
| 7,650,916 | B2 * | 1/2010 | Clusserath | B67C 3/002 141/198 |
| 7,866,123 | B2 * | 1/2011 | Clusserath | B67C 3/22 141/144 |
| 7,997,048 | B2 * | 8/2011 | Bernhard | B67B 3/2033 53/253 |
| 8,256,474 | B2 * | 9/2012 | Stienen | B65B 39/004 141/144 |
| 8,291,948 | B1 * | 10/2012 | Marks | B67C 3/26 141/369 |
| 8,701,721 | B2 * | 4/2014 | Seeman | B65B 3/30 141/181 |
| 8,936,052 | B2 * | 1/2015 | Beisel | B67C 3/22 141/144 |
| 9,108,836 | B2 * | 8/2015 | Clusserath | B67C 3/2622 |
| 9,174,757 | B2 * | 11/2015 | Deckert | B65C 9/1819 |
| 9,193,574 | B2 * | 11/2015 | Krulitsch | B67C 3/26 |
| 9,624,039 | B2 * | 4/2017 | Clusserath | B67C 3/242 |
| 9,670,046 | B2 * | 6/2017 | Clusserath | B67C 3/225 |
| 9,878,891 | B2 * | 1/2018 | Balzarin | B67C 3/225 |
| 9,896,281 | B2 * | 2/2018 | Krulitsch | B65G 49/00 |
| 9,902,603 | B2 * | 2/2018 | Clusserath | B67C 3/10 |
| 9,908,766 | B2 * | 3/2018 | Seewald-Raider | B67C 3/244 |
| 2003/0106779 | A1 * | 6/2003 | Stocchi | B65G 29/00 198/803.3 |
| 2005/0045244 | A1 | 3/2005 | Hartness et al. | |
| 2005/0284731 | A1 * | 12/2005 | Hartness | B67C 3/225 198/465.4 |
| 2007/0034281 | A1 | 2/2007 | Brown et al. | |
| 2007/0113919 | A1 * | 5/2007 | Gruson | B67C 3/001 141/91 |
| 2010/0192521 | A1 * | 8/2010 | Clusserath | B67C 3/20 53/473 |
| 2011/0180179 | A1 * | 7/2011 | Krakers | B65B 55/04 141/11 |
| 2012/0018030 | A1 * | 1/2012 | Laumer | B67C 3/001 141/1 |
| 2012/0138192 | A1 * | 6/2012 | Campi | B67C 3/04 142/6 |
| 2013/0112315 | A1 * | 5/2013 | Clusserath | B67C 3/22 141/67 |
| 2013/0180619 | A1 * | 7/2013 | Clusserath | B67C 3/06 141/6 |
| 2013/0220481 | A1 * | 8/2013 | Hartel | B67C 3/045 141/9 |
| 2014/0174597 | A1 * | 6/2014 | D'Errico | B65B 31/044 141/47 |
| 2015/0090404 | A1 * | 4/2015 | Van Wickeren | B65B 17/02 156/556 |
| 2016/0009535 | A1 * | 1/2016 | Clusserath | B67C 3/225 141/145 |
| 2016/0025267 | A1 * | 1/2016 | Clusserath | B67C 3/10 141/4 |
| 2016/0046476 | A1 * | 2/2016 | Clusserath | B65G 47/846 141/170 |
| 2017/0166429 | A1 * | 6/2017 | D'Errico | B67C 3/204 |
| 2018/0118396 | A1 * | 5/2018 | Lindberg | B65B 57/145 |

FOREIGN PATENT DOCUMENTS

| | | |
|---|---|---|
| DE | 10 2004 011 101 | 3/2006 |
| DE | 10 2006 033 111 | 1/2008 |
| DE | 102007030559 | 1/2009 |
| GB | 2 036 703 | 7/1980 |
| WO | WO 2012/013255 | 2/2012 |

* cited by examiner

CONTAINER-TREATING MACHINE

RELATED APPLICATION

This application is the national stage entry of PCT/EP2012/002575, which claims the benefit of the Aug. 30, 2011 priority date of German application DE 102011111483.5, the contents of which are herein incorporated by reference.

FIELD OF INVENTION

The invention relates to a container-treating machine.

BACKGROUND

A known way to control filling in a filling machine is to use a probe. These probes typically extend into the container through its container opening during filling. Examples of such probes are electrical fill-level probes with at least one probe contact that, when dipped into the filling material level as it rises in the container during filling, triggers a probe signal. This probe signal serves as a basis for closing the liquid valve or triggering such closure with a delay, so that the particular target fill-level or target fill-depth in the container is reached.

Another kind of probe for determining the fill-depth uses gas-return pipes. These are used when the container is sealed against a filling machine. In this case, incoming filling material displaces the gas already in the container. This gas escapes through the gas-return pipes. Eventually, the liquid rises enough to submerge the opening to the gas-return pipes. At this point, gas can no longer escape. The resulting pressure buildup halts further entry of liquid.

In all known filling systems that use a gas-return pipe, the closing of the particular filler element or of the liquid valve occurs only after an interval of a varying duration and at a specified position or angular position of the movement of the rotating transporting element. This may occur long after the target fill depth has been reached. This delay results in some disadvantages.

One disadvantage is a risk that, in the time it takes to close the liquid valve after the liquid has reached the target fill level, a malfunction may cause over-filling of the container. These malfunctions can arise from many causes, such as pressure fluctuations, sudden changes in the speed of rotation of the transporting element, and/or by shaking. Moreover, there is frequently no way to avoid having the filling material rise well into the gas-return pipe or into its gas-return channel after the gas-return pipe has dipped into the filling material level of the filling material.

Another disadvantage is the need to empty the gas-return pipe into the relevant container at the end of the actual filling phase to prevent the dripping of the filling material when the filled container has been removed from the filler element. Waiting for this dripping to occur wastes time. And if one does not wait long enough, there is a risk that contamination in one container will spread to subsequently filled containers.

It is also known in the art to design the probes that determine the fill depth, such as electrical fill-level probes or gas-return pipe for setting the fill depth or the fill level, to be axially height-adjustable.

SUMMARY

To carry out the particular treatment, different functional elements are needed at the treatment positions. These functional elements are adapted to the type of treatment, in particular functional elements with which a relative movement needed for the treatment is made between the particular container and a treatment block for the supply and/or removal of treatment media into and out of the containers, functional elements for controlling the supply and/or removal of the treatment media, functional elements in the form of sensors and/or measuring systems for controlling and/or monitoring the particular treatment, in particular also the quantity of the treatment medium supplied and/or removed, for example also pressure sensors for measuring and/or monitoring the internal pressure of the containers during the treatment, and functional elements in the form of probes extending into the containers during the filling, determining the fill depth or the fill level, such as electrical fill-level probes and/or pipe-shaped probes, such as gas-return pipes or TRINOX™ tubes, that can also be used for the introduction of an inert gas (e.g. $CO_2$ gas) into the headspace of the particular filled container, this being to force oxygen out of this headspace by the controlled foaming of the filling material.

With a multiplicity of treatment positions on the particular rotating transporting element, for example on the rotating rotor, of a treating machine, this has hitherto meant a high structural and control input, as all the functional elements required for the treatment are provided and controlled separately for each treatment position.

The purpose of the invention is to substantially reduce complexity in the structural, assembly, and control input of a container-treatment machine without adversely affecting the quality of the treatment.

In one aspect of the invention, at least two treatment positions are made on one treatment block, that is then mounted, preferably prefabricated, as a complete and fully functional module on the transporting element of the container-treatment machine, for example, on its rotor. If a defect develops, operation can quickly resume upon swapping out the defective module and replacing it with a new one. This contributes decisively to a reduction in the production cost in the manufacture of the particular container-treatment machine.

As used herein, "pressure filling" means a filling method in which the container to be filled lies in a sealed position against the filler element and is pre-tensioned before the actual filling phase, i.e. before the liquid valve is opened, through at least one controlled gas path formed in the filler element, with a pressurization gas under pressure (inert gas or $CO_2$ gas), which is then forced out of the container's interior as a return gas as the container fills with filling material, with the return gas being forced out through at least one controlled gas path formed in the filler element. Further treatment phases can precede this pre-tensioning phase, for example the evacuation and/or the purging of the inside of the container with an inert gas, e.g. $CO_2$ gas etc., this being likewise being carried out through gas paths formed in the filler element.

As used herein, "pressure-free filling" means a filling method in which the container to be filled lies with its container mouth in a sealed position against the filler element, and in which the inside of the container is pre-treated before the actual filling phase, i.e. before the liquid valve is opened, through controlled gas paths formed in the filler element, for example by evacuating and/or purging with an inert gas, for example $CO_2$ gas, whereby, during the filling, the gas that is forced out by the filling material as it flows into the container is removed from the inside of the container as a return gas through at least one controlled gas path formed in the filler element.

As used herein, "free-jet filling" means a process in which the liquid filling material flows into the container to be filled in a free filling jet, wherein the container mouth or opening of the container does not lie against the filler element, but is at a distance from the filler element or from a filling material outlet. A substantial feature of this process is also that the air forced out of the container during the filling process by the liquid filling material does not get into the filler element or into an area or channel formed therein that conveys gas. Instead, it flows freely out into the environment.

As used herein, "TRINOX™ tube" means a tube-shaped probe extending into the containers during filling, the probe being used in the so-called TRINOX™ method. In this method, there is first a slight over-filling of the particular container under filling pressure. This is followed by a fill-depth correction phase to remove the overfilled filling material. During this fill-depth correction phase, a sterile inert gas, for example $CO_2$, at a pressure lying above the filling pressure or the pressure prevailing in the filling material tank, is released into a headspace of the container. The pressure of this inert gas forces filling material through the probe or its probe channel back into the filling material tank until the probe opening is outside the filling material, thus causing the target fill-depth to be reached.

As used herein, "container in a sealed position with the filler element" means that the container to be filled is tightly pressed with its container mouth against the filler element or on a seal associate with the filler element so that it surrounds a discharge opening of the filler element.

As used herein, "containers" include cans and bottles made of metal, glass and/or plastic, as well as other packaging configurations that are suitable for filling with liquid or viscous products using either pressure filling or pressure-free filling.

As used herein, the "headspace" of the containers is the part of the interior of a container underneath the container opening, that is not taken up by the filling material after filling.

As used herein, the expression "substantially" means deviations from exact values in each case by +/−10%, and preferably by +/−5% and/or deviations in the form of changes not significant for functioning.

As used herein, the term "container-treating machines" includes filling machines for filling containers with a liquid filling material, as well as other machines for treating containers, in particular machines for cleaning containers, for example rinsing machines, and/or machines for sterilizing containers, in particular also those in which the sterilization of containers occurs by their treatment with a medium in the form of a gas and/or vapor containing a sterilization agent, for example a medium in the form of a gas and/or a vapor containing $H_2O_2$. As used herein, the term "probes determining the fill depth" includes particular electrical fill-level probes with at least one electrical probe contact and/or pipe-shaped probes, such as gas-return pipes or TRINOX™ tubes, and/or pipe-shaped probes, such as gas-return pipes or TRINOX™ tubes, with at least one electrical-probe contact.

The term "treatment media" includes, for example, the filling material introduced into the containers during filling and/or media in liquid form and/or gas form and/or vapor form, that are introduced into the containers during the filling, cleaning and/or sterilization and/or that are removed from the containers, in particular media used for pre-treatment during filling, return gas forced out or removed from the containers during filling or pressure release, cleaning and/or sterilization media.

Further developments, benefits, and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

The invention is explained in more detail below by means of the figures using an example of an embodiment. The following are shown.

DETAILED DESCRIPTION

Figure 1:
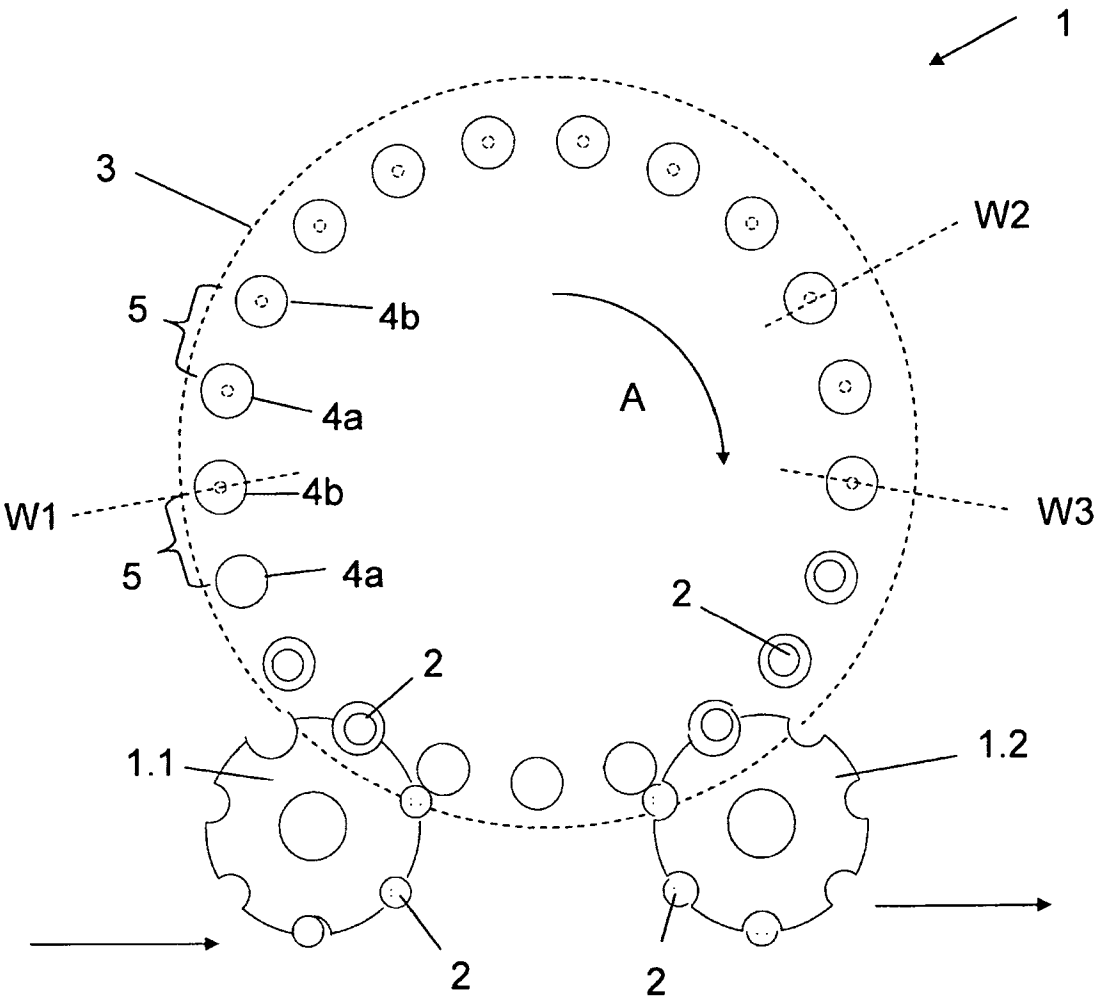
FIG. 1 shows a plan view of a filling machine with filling points around a rotor thereof.

FIG. 1 shows a filling machine 1 that fills container 2, such as bottles, with liquid filling-material. The filling machine 1 is a rotating machine having a rotor 3 that rotates around a vertical machine-axis along a rotation direction A.

A succession of filling points extends around the rotor 3. Each filling point includes a treatment block 5 having first and second treatment positions 4*a*, 4*b*. The treatment blocks 5 are disposed either on the rotor's periphery or on an annular rotor element 3.1 that rotates with the rotor 3. Each treatment block 5 is a fully functional pre-assembled module. As such, each treatment block 5 can easily be inserted and removed from the rotor 3. This simplifies fabrication of the filling machine 1. Additionally, in the event of any defect, a treatment block 5 can be replaced fairly quickly The filling points are placed next to each other along the rotor's circumference and at the same radial distance from the vertical machine-axis. A common angular extent separates adjacent filling points. As one proceeds in the rotation direction A, a second treatment position 4*b* follows each first treatment position 4*a* and another first treatment position 4*a* follows that second treatment position 4*b*.

Figure 2:
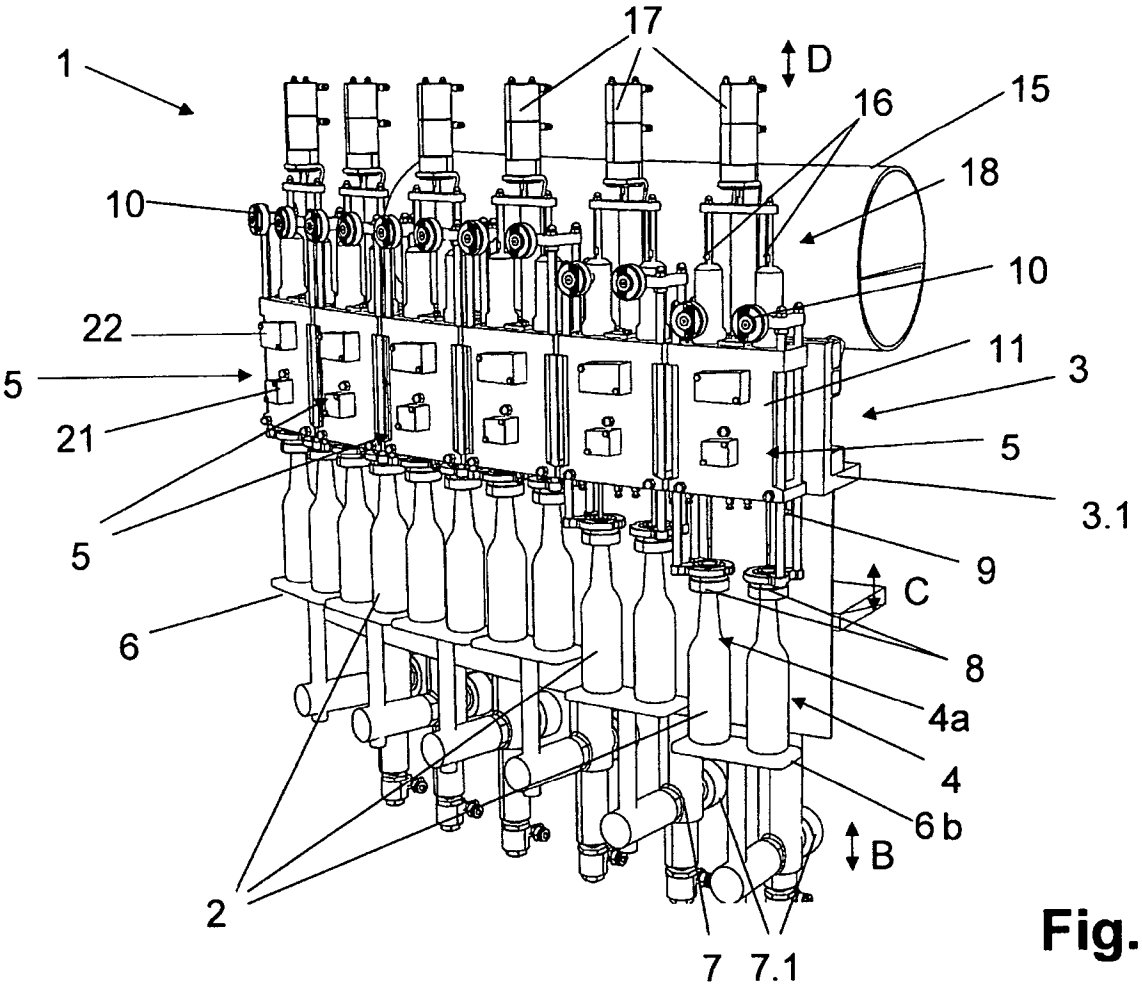
FIG. 2 is an isometric view of part of the rotor of the filling machine in FIG. 1 in which treatment blocks can be seen.

FIG. 2 shows a container carrier 6 that is common to the first and second treatment positions 4*a*, 4*b*. In the illustrated embodiment, the container carrier 6 is a rectangular container-carrying plate that is oriented with its longer sides tangential to the circular rotary path of the rotor 3 and on which the containers 2 stand on their container bases. A joint lifting element 7, such as a pressure cylinder is assigned to each treatment block 5 for lifting the container carrier 6.

Each lifting element 7 has a cam follower 7.1 that interacts with a control cam. Under the control of the control cam, a lifting element 7 raises or lowers its corresponding container carrier 6 along a lifting direction B. It does so synchronously with the rotor's rotation.

Each treatment block 5 has two centering bells 8 to hold and center the containers 2 in the area of their container openings 2.1. These centering bells 8 are likewise distributed at regular angular distances from each other around the vertical machine axis. One centering bell 8 is assigned to the first treatment position 4*a* and the other centering bell 8 is assigned to the second treatment position 4*b*.

In the illustrated embodiment, the centering bells 8 are on lower ends of two corresponding guide rods 9. The guide rods 9 extend parallel to the machine axis. Their top ends project over the treatment blocks 5. These top ends have cam followers 10 that interact with at least one control cam for controlled lifting and lowering synchronously with the rotary movement of the rotor 3 along the lifting direction C.

A multi-part housing 11 of the treatment block 5 guides the guide rods 9. The guide rod 9 for the first treatment position's centering bell 8 runs along the rear side of the housing 11. The guide rod 9 for the second treatment position's centering bell 8 runs along a front side of the housing 11. The rear and front sides of the housing 11 are identified in relation to the rotor's direction of rotation A.

In an alternative embodiment, the two centering bells 8 can also be arranged in a common holding-frame. The upward and downward movement required to center the bottles occurs, in this case, for both centering bells, as a result of a common movement-roller.

A difficulty that arises in pairwise processing of bottles is that the bottles may have slightly different heights. This means that only the taller bottle can be brought into a defined pressing and sealed position. As a result, flexible compensation elements would need to be arranged on the bottle plate or inside the centering bell 8. Examples of suitable compensation elements include springs and rubber cushions.

In operation, empty containers 2 enter at a container inlet 1.1, best seen in FIG. 1. From there, the empty containers 2 are transferred onto the container carrier 6, which is lowered into its lower position. Filled containers 2 are removed from the container carrier 6 lowered into its lower position on a container outlet 1.2 of the treating machine 1. In order to ensure a secure transfer of the containers 2 and, above all, to reliably avoid the tipping of the containers 2, the centering bells 8 of each treatment block 5 are independently controlled.

Figure 3:
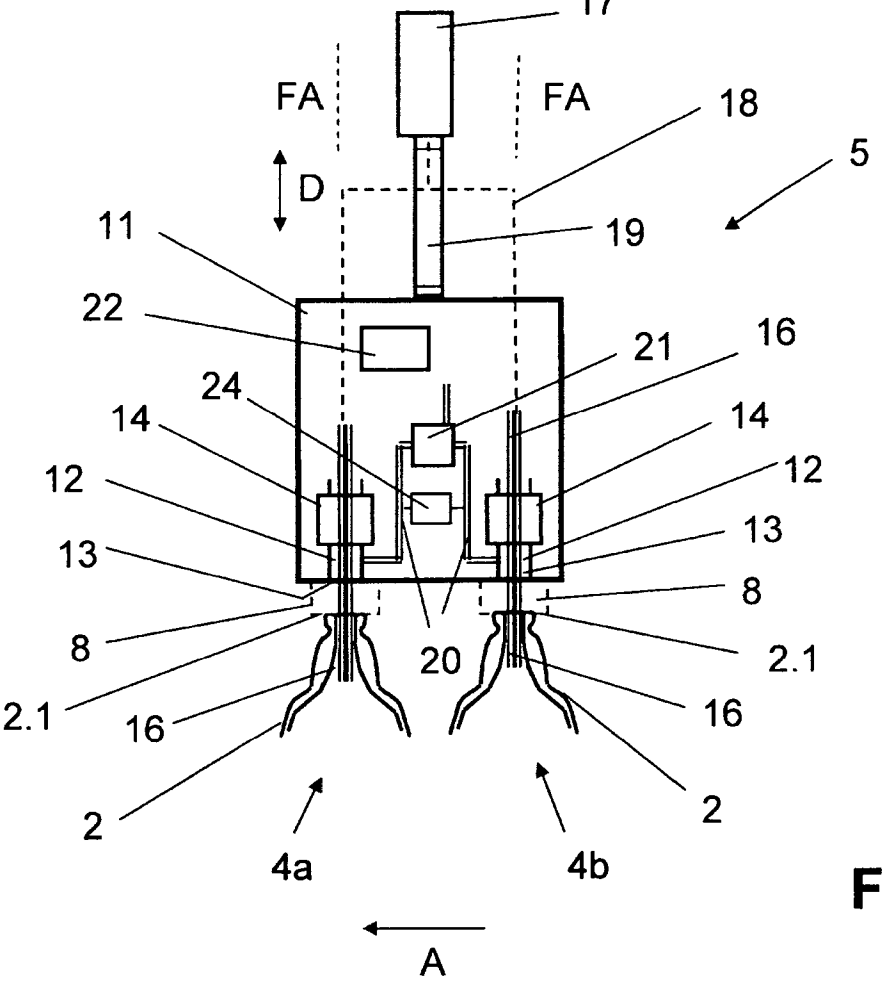
FIG. 3 is a simplified representation of one of the treatment blocks in FIG. 2.

Referring now to FIG. 3, within a treatment block's housing 11 are two liquid channels 12. These channels 12 open up at corresponding annular dispensing openings 13 on the underside of the treatment block 5. During the filling phase, the filling material flows through these channels 12 and enters a particular container 2 through its container opening 2.1.

During pressure-filling, container carrier 6 lifts the two containers 2 so that they stand with their container mouths 2.1 centered by corresponding centering bell 8 and sealed against the treatment block 5. In contrast, during free-jet filling, the containers are positioned with their container openings 2.1 at a distance from the treatment block 5.

Each liquid channel 12 has its own separate and independently controllable liquid valve 14. The valve 14 opens at the start of the filling phase and closes at the end of the filling phase.

Referring again to FIG. 2, an annular tank 15 on the rotor is at least partially filled with filling material during the filling operation. This forms a gas space above a liquid space. The filling material occupies the liquid space. The liquid channels 12 of all treatment blocks 5 connect to the tank's liquid space.

Referring back to FIG. 3, each treatment position 4*a*, 4*b* has a corresponding probe 16. A probe signal from each probe 16 permits control over filling depth in the container into which the probe 16 is inserted. These probe signals are independent of each other. This means that containers at the first and second treatment positions 4*a*, 4*b* can be independently filled.

In some embodiments, the probe 16 is an electrical fill-level probe with a probe end thereof having a probe contact. In other embodiments, the probe 16 is a pipe having an open probe-end that extends through the container opening 2.1 and the inside of the container 2.

The probes 16 can be moved axially in a direction parallel to the machine axis along a probe-movement direction D. This makes it possible to set different fill depths for different containers 2. It also makes it possible the probe 16 to emerge from its starting position at the start of the filling phase and to retract it back into its starting position at the end of the filling phase. In the starting position, the probe 16 is held completely or substantially completely in the treatment block 5 or its housing 11.

In the illustrated embodiment, a common actuating drive 17 moves the two probes 16. A suitable actuating drive 17 is a pneumatic cylinder. A rod 18 connects the two probes 16 to the actuating drive 17. In the illustrated embodiment, a bow-shaped holder 19 attaches the actuating drive 17 to the top of the treatment block's housing 11. As a result, the actuating drive 17 is above the treatment block 5 and also above the movement path of the cam followers 10.

Figure 4:
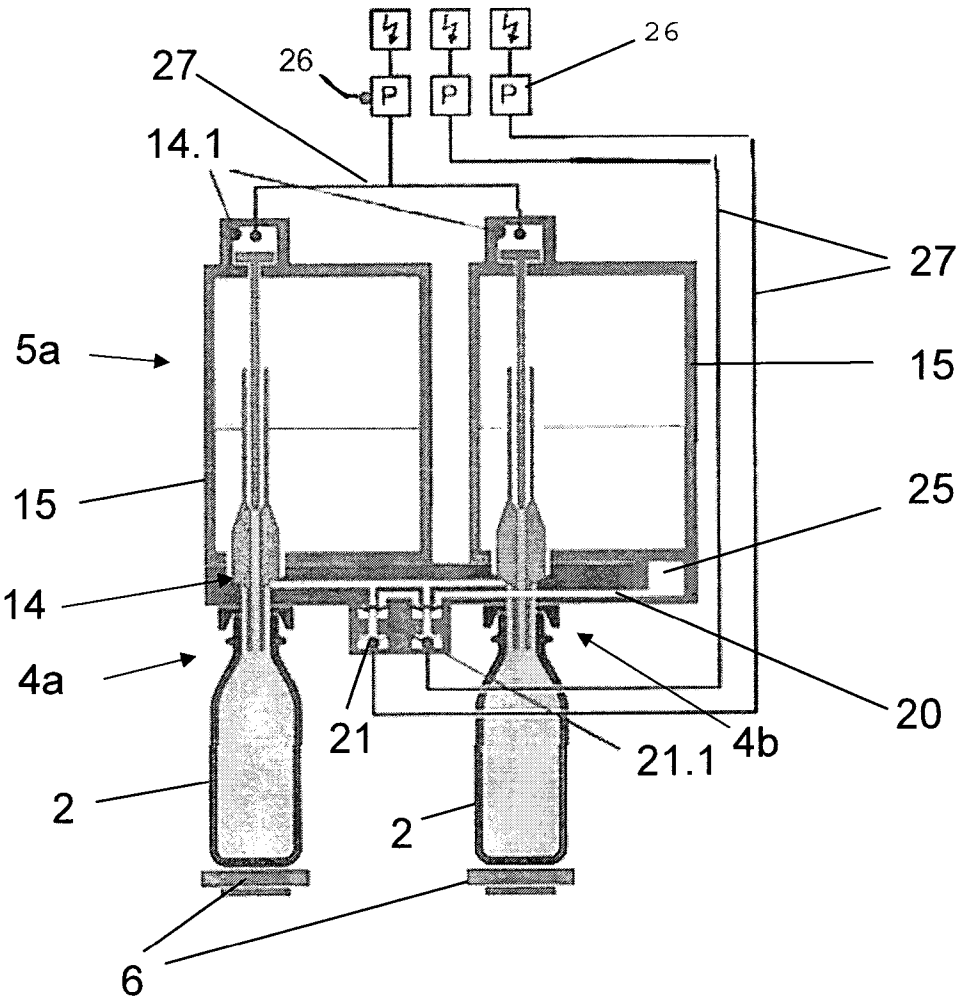
FIGS. 4 and 5 show alternative embodiments of one of the treatment blocks in FIG. 2.

Referring now to FIG. 4, within a particular treatment block 5, or in the housing 11 thereof, at least one controlled gas path 20 with at least one control valve 21 is formed. These are used in connection with the pre-treatment of the containers 2 before the filling phase.

Examples of pre-treatment arise in pressure filling when the container 2 stands with its mouth sealed against the treatment block. These examples include purging the container with an inert gas, returning a gas that is forced out of the container during filling, and releasing pressure of a container's headspace once the container has been filled.

In the illustrated embodiment, the gas path 20 and the control valve 21 serve both the first and second treatment positions 4*a*, 4*b* of the treatment block 5. As such, they need be provided only once on a particular treatment block 5. In the illustrated embodiment, the gas path 20 and the control valve 21 are on the radially outer side of the treatment block 5.

In a practical embodiment of the filling machine 1, each treatment block 5 has two or more gas paths 20 with control valves 21. These gas paths 20 and control valves 21 are jointly provided in turn for the first and second treatment positions 4*a*, 4*b* of each treatment block 5.

Referring back to FIG. 2, a control-electronics module 22 processes the probe signals from the probes 16 and uses them as a basis for controlling the liquid valves 14 or their actuation elements, for controlling the actuating drive 17, and/or for controlling control valves 21 that are also provided jointly for the first and second treatment positions 4*a*, 4*b* of each treatment block 5. As a result, the control-electronics module 22 is easily accessible on the radially-outer side of the treatment block 5.

In some embodiments, for the first and second treatment positions 4*a*, 4*b* of each treatment block 5, with the exception of the liquid valves 14 and the functional elements effecting the controlled raising and lowering of the centering bells 8, namely the guide rod 9, the cam followers 10, and the probes 16, all other functional elements, namely the particular container carrier 6, the controlled gas path 20, the actuating drive 17 for the probe movement, and the control-electronics module 22 for the two treatment positions 4*a*, 4*b*, are provided jointly in the treatment block 5.

However, other embodiments combine the centering bells 8 or other elements on the first and second treatment positions 4*a*, 4*b* effecting the centering and/or an additional halt for the containers 2 to form one functional unit.

In some embodiments, a common container-carrier 6 is assigned to the first and second treatment positions 4*a*, 4*b* of each treatment block 5. This container carrier 6 can be raised and lowered with the help of a cam follower 7.1.

However, in other embodiments, the first and second treatment position 4*a*, 4*b* each have their own container carrier 6. This container carrier 6, jointly, with the other container carrier of the same treatment block 5, or independently of the other container carrier of the same treatment block 5, can be raised and lowered in a controlled manner, for example once again with the assistance of a cam follower 7.1.

In some embodiments, the probe 16 determines the fill depth of the filling material in a particular filled container 2. However, in other embodiments, a flowmeter can be used alone or with a probe 16. An example of such a flowmeter is a magnetically inductive flowmeter.

A flowmeter can be used to determine the filling material quantity flowing towards a particular container 2 during filling thereof and to send a measurement signal that controls the liquid valves 14. Since the flowmeter provides data concerning a single container, it is preferable to provide independent flowmeters for each treatment position 4*a*, 4*b* or in the liquid channel that leads to that treatment position 4*a*, 4*b*.

In those embodiments that carry out pressure-filling, each treatment block 5 has at least one pressure sensor 24. The pressure sensor 24 captures or monitors the pressure in the two containers 2. This information can be used to enable monitoring and/or controlling of the filling process.

With the previously described design of the treatment blocks 5, it becomes possible to control individual functional elements in various ways. These controls are summarized in the table below.

For controlled relative movement between the containers 2 and the treatment blocks 5, it is possible to control the lifting elements 7 either individually or jointly.

To set the fill depth in the containers 2, it is possible to change a corresponding setting of the probes 16 either individually or jointly. This is possible regardless of whether the probe 16 is a gas-return pipe, a TRINOX™ tube, or an electrical fill-level probe. It is also possible whether or not a flowmeter is used.

It is also possible to close the liquid valves 14 and to actuate the actuation elements for these valves individually or jointly regardless of the design of the probes 16 and regardless of the presence or absence of the flowmeters, as long as the probes are gas-return pipes or TRINOX™ tubes. However, it is not possible to carry out joint closing of the liquid valves 14 the probes used to determine the fill depth are electrical fill-level probes or where flow meters are used.

It is also possible to open the liquid valves 14 or their actuation elements 14.1 either individually or jointly. This can be done regardless of the design of the probes 16 and regardless of the presence or absence of flowmeters.

It is also possible to purge of the containers 2, for example by using the probes 16 as purging pipes that are raised and lowered in a controlled manner. This can be done individually or jointly, regardless of the design of the probes 16 and regardless of the presence or absence of the flowmeters.

It is also possible to use the pressure sensor 24 to carry out pressure monitoring of the filling process. This can be done individually regardless of the probe's design and regardless of the presence or absence of the flow meters. In this case, each filling position 4*a*, 4*b* has its own pressure sensor 24.

It is also possible to adjust the heights of the centering bells 8 either individually or jointly, regardless of the probes' design and regardless of the presence or absence of the flowmeters. In the latter case, however, the control valves 21 and the liquid valve 14 of both treatment positions 4*a*, 4*b* have to be controlled together. The common pressure sensor 24 is then connected to the gas space of both containers 2 arranged in a sealed position at the treatment block 5. With the particular pressure sensor 24, and even with the joint pressure sensor 24 for both treatment positions 4*a*, 4*b*, it is possible to monitor, for example, the bursting of a container 2 during pressure-filling.

In some embodiments, the control valves 21 and the actuation element 14.1 for the liquid valve 14 are pneumatic. As such, they can be implemented as gas cylinders. The following table summarizes some of the available control functions.

| Function | Implementing element | Type of actuation | Fill-depth determination by gas-return pipe or TRINOX ™ tube | Fill-depth determination by probe or MID 23 | Comments |
|---|---|---|---|---|---|
| Controlled relative movement between treatment blocks 5 and containers 2 | Lifting element 7 | Individual | Possible | Possible | |
| | | Joint | Possible | Possible | |
| Setting of the fill depth by height adjustment | Probe 16 as a gas-return pipe or TRINOX ™ tube | Individual | Possible | No | |
| | | Joint | Possible | No | |
| | Probe 16 as an electric | Individual | No | Possible | |

-continued

| | | | | | |
|---|---|---|---|---|---|
| | fill-level probe | Joint | No | Possible | |
| | MID 23 | | No | No | MID 23 is not height-adjusted |

| Function | Implementing element | Type of actuation | Fill-depth determination by gas-return pipe or Trinox tube | Fill-depth determination by probe or MID 23 | Comments |
|---|---|---|---|---|---|
| Height-adjustment of the centering bells 8 | Centering bells 8 | Individual | Possible | Possible | |
| | | Joint | Possible | Possible | |
| Closing of the liquid valves 14 | Liquid valve 14 or its actuation elements | Individual | Possible | Possible | |
| | | Joint | Possible | No | |
| Opening of the liquid valves 14 | Liquid valve 14 or its actuation elements | Individual | Possible | Possible | |
| | | Joint | Possible | Possible | |
| Optimized purging of the containers by controlled raising of the purging pipe | Probe 16 as a purging pipe | Individual | Possible | Possible | |
| | | Joint | Possible | Possible | |
| Pressure monitoring of the filling process | By pressure sensor 24 | Individual | Possible | Possible | |
| | | Joint | Possible | Possible | |

FIG. 4 shows a treatment block 5*a* that differs from the treatment block 5 shown in FIG. 3. The difference arises because the liquid valves 14 are on the underside of the annular tank 15. The elements that correspond, at least in terms of their function, to the elements in FIGS. 1-3, are labeled in FIG. 4 in each case with the same reference numbers as in FIGS. 1-3.

FIG. 4 shows two pneumatically actuated control valves 21. These control valves 21 are common to the first and second treatment positions 4*a*, 4*b*. The control valves 21 control gas paths 20 formed in the treatment block 5*a*. They also control a connection between an outer annular-channel 25 that is formed on the rotor, and the gas spaces of the containers 2, which are sealed against the treatment block 5*a*. The outer annular-channel 25 is common to all the treatment blocks 5*a* and their treatment positions 4*a*, 4*b*.

The figure also shows the two pneumatic actuation elements 14.1 implemented as gas cylinders. These actuate the liquid valves 14. Through pneumatic control-lines 27, they also actuate pneumatic valves 26, which are electrically actuated, that pneumatically control the control valves 21 and also the actuation elements 14.1 through additional pneumatic control-lines 27.

Figure 5:
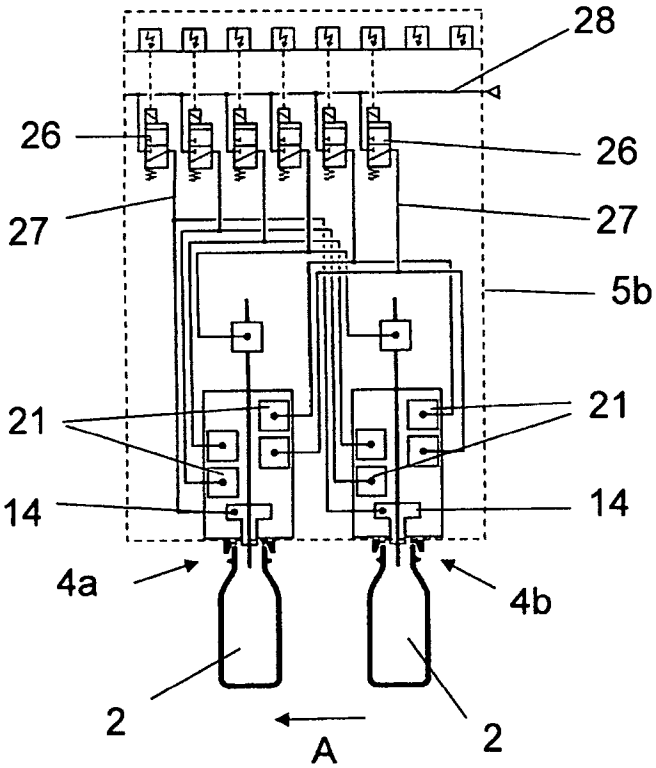

FIG. 5 shows a further embodiment of a treatment block 5*b* that is one of many treatment blocks of the same kind on the periphery of the rotor 3. The treatment block 5*b* shown in FIG. 5 has more control valves 21 than the treatment block 5*a* shown in FIG. 4. This greater number arises because there are more controlled gas paths and because for each control valve 21 assigned to the first treatment position 4*a* there is a corresponding control valve 21 assigned to the second treatment position 4*a*, 4*b*.

Pneumatic control lines 27 connect corresponding control valves 21 of the first and second treatment position 4*a*, 4*b* to the same pneumatic valve 26. Corresponding control valves 21 of the two treatment positions 4*a*, 4*b* are thus actuated jointly or at different times.

In the same way, control lines connect the liquid valves 14 assigned to the first and second treatment positions 4*a*, 4*b*, and in particular, their actuation elements 14.1, to a pneumatic valve 26 that is common to both the first and second treatment positions 4*a*, 4*b*. This permits the liquid valves 14 to be opened together for the start of the filling, while the end of the filling or of the filling phase occurs individually in each case.

A pressure-medium line 28 supplies a pressure medium needed to control the control valves 21 and the actuation elements 14.1. A suitable pressure medium is sterile compressed air.

Figure 6:
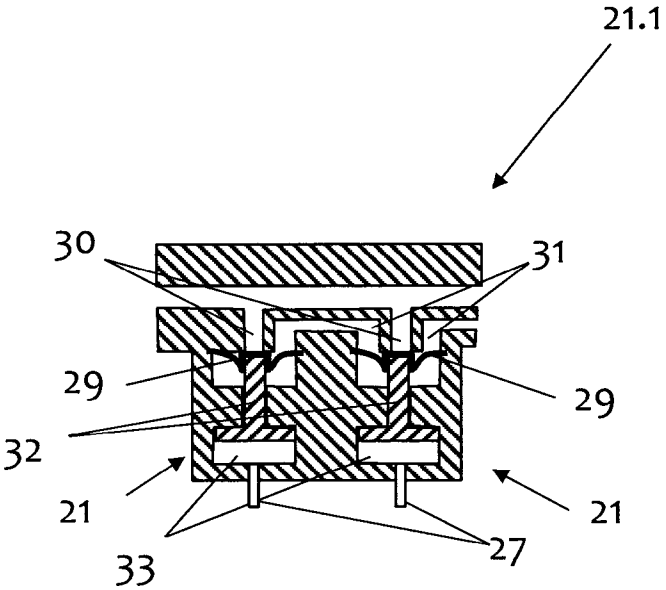
FIG. 6 is a simplified view of two pneumatically actuated control valves or gas cylinders of the treatment block shown in FIG. 3.

FIG. 6 shows, again in a magnified representation and in detail, two control valves 21 that are combined to form one combined control valve 21.1. A substantial component of each control valve 21 is a membrane-like valve body 29 that operates between a valve inlet 30 arranged in the gas path 20 and a valve outlet 31 likewise arranged in the gas path 20, that closes the valve inlet 30 in the representation in FIG. 6 and that is held in this situation by the piston 32 of a pneumatic piston-cylinder arrangement, provided that the associated cylinder space 33 is impacted with the pressure of the pneumatic control medium (compressed air). Each cylinder space 33 is connected to the associated pneumatic valve by a control line 27.

Figure 7:
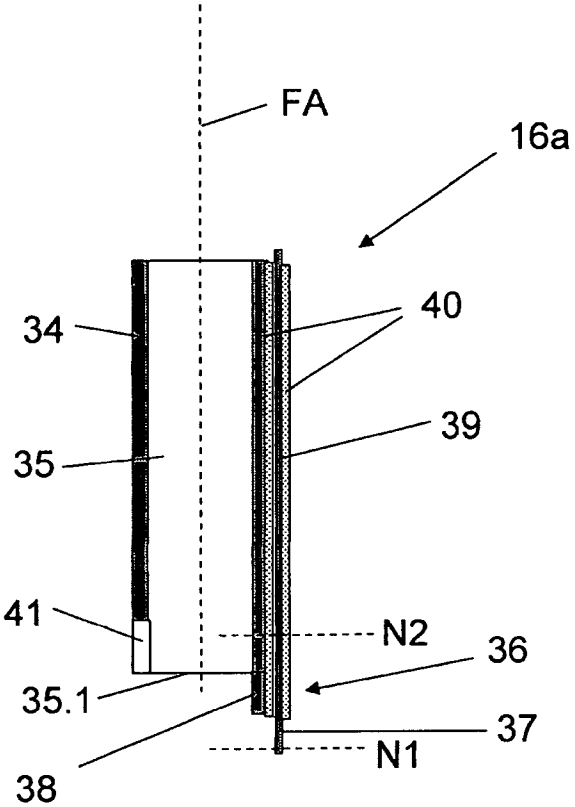
FIG. 7 is a longitudinal section of the lower end of a probe for determining fill depth of filling material in a container.

FIG. 7 shows, in a simplified partial representation and in cross-section, the lower end of a probe 16 in its design as a combined electrical fill-level probe and pipe-shaped probe or gas-return pipe and/or TRINOX™ tube.

With the embodiment of the filling machine 1 and its treatment blocks 5, 5*a*, 5*b* as described herein, it is possible to implement a hitherto unprecedented multiplicity of process variants. These can be selected and controlled, for example, by software executing on a control computer of the filling machine 1. Depending on the requirements of the treatment needed in each case, or the container/treatment medium, or filling material, an optimally adapted treatment can be selected. The following treatment or process steps are possible:

1. Retracting and extending the probe 16, in particular when the probe 16 is implemented as a gas-return pipe;
2. Automatically adjusting fill-height by using the actuating drive 17 to adjust the probe's height;
3. Evacuating the container's interior when that container is sealed on a treatment position 4*a*, 4*b* and purging the container's interior with an inert gas by extending a probe 16 deep into the container 2;
4. Evacuating the container's interior and purging it with an absolutely dry inert gas through the filling-material dispensing opening 13;
5. Purging the containers 2, in particular plastic containers, with $CO_2$ gas at a pressure level lying slightly above the ambient pressure for low-oxygen filling;
6. Dry pre-tensioning a container 2 that is sealed against the treatment position 4*a*, 4*b* through the annular gap of the dispensing opening 13;
7. Pre-tensioning a container, either using a probe 16 implemented as a gas-return pipe or using the filling material dispensing opening 13;
8. During fast-filling, returning displaced gas using the annular gap or the filling material dispensing opening 13 with a large cross-section and possibly also additionally using a gas-return channel of a probe 16, as a gas-return pipe;
9. During slow-filling, using a gas-return channel of a probe 16 as a throttled gas path;
10. Using time control to switch between fast and slow filling;
11. Using a probe contact 37 of an electrical fill-level probe to switch between fast and slow filling;
12. In case an electrical fill-level probe fails, determining the fill depth solely by the probe 16 formed as a gas-return pipe using the principle that additional liquid can no longer enter a container once the gas-return pipe is immersed in liquid since displaced gas can no longer escape from the container and therefore forms a barrier to further entry of liquid;
13. Determining fill depth of a container using only the probe contact 37 and by using an electrical probe signal to close a liquid valve 14 associated with that container;
14. Determining fill depth using a probe 16 formed as a gas-return pipe or using the principle of a gas-return pipe/gas barrier in combination with a probe signal of provided by the probe contact 37;
15. Subsequently purging the headspace of a filled container with inert gas through a probe implemented as a length of pipe;
16. Allowing a filled container to settle by releasing pressure inside the container through a pressure-release channel, such as the annular channel 25, until that pressure is only slightly above atmospheric pressure;
17. Allowing a filled container to settle by releasing pressure inside the container through a pressure-release channel, such as the annular channel 25, until the pressure inside the container reaches ambient pressure;
18. Filling without evacuating the containers, but instead by purging the container with inert gas with absolutely dry pre-tensioning-separation of a pre-tensioning and a gas-return path, which can be the filling material dispensing opening 13 and the central length of pipe formed by the probe 16, respectively;
19. Optionally carrying out either pressure-filling or pressure-free filling;
20. Detecting an unfilled container 2 using a probe 16 that is implemented as either a gas-return pipe or as an electric fill-level probe;
21. Controlling functional elements at different treatment positions 4*a*, 4*b* that correspond to each other within the same treatment block 5, 5*a*, 5*b*, thereby permitting simultaneous actuation or triggering thereof, without adversely affecting the quality of the treatment or of the filling process.

Figure 8:
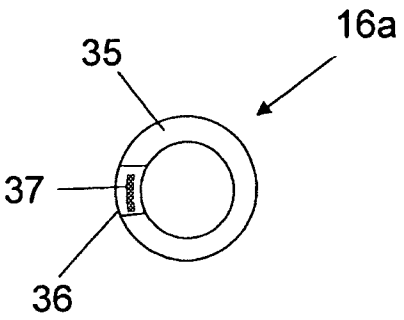
FIG. 8 is a transverse section of the probe shown in FIG. 7.

FIGS. 7 and 8 show a probe 16*a* implemented as an electrical fill-level probe mounted on distal end of a pipe 34 that extends coaxially with a filler-element axis FA. The pipe 34 is a gas-return pipe that forms a gas-return channel 35 having an opening 35.1 at a distal end thereof. During filling, the distal end extends into a headspace of a container 2. As liquid enters the container 2, it forces out any gas that remains in the container 2. As long as the opening 35.1 remains above the rising level of the liquid, the gas escapes through the gas-return channel 35 and the controlled gas paths 20.

One way to control filling height is to set the lower end of a gas-return pipe at the desired filling height. Once liquid rises enough to immerse the lower end, gas can no longer be displaced out of the container 2. Once this occurs, the gas pressure inside builds up to the point where it acts as a barrier to further entry of liquid. Only at a later time, i.e. at a specified angular position of the rotary movement of the rotor 3, does the liquid valve 14 actually close. Until then, the container 2 relies on the gas barrier to keep further liquid from entering.

To avoid the disadvantages inherent in the foregoing method, it is possible to provide a probe contact 37 at the distal end of the probe 16, as shown in FIG. 7. This probe contact 37 is outside the gas-return channel 35 on a separate lance-type or fishplate-type section 36 of the pipe 34. The probe contact 37 extends downward towards the container carrier 6 from the lower open end 35.1 of the gas-return channel 35 in a direction parallel to the filler-element axis FA.

In the illustrated embodiment, the lance-type section 36 extends a short way along the pipe's circumference and is partially formed by a lance-type or fishplate-type continuation 38 of the pipe's wall. This continuation 38 is electrically conductive, and preferably made of metal. A conductive path 39 extends along the probe 16. For most of its length, insulation 40 covers the conductive path 39. An exposed portion of this conductor path, which extends between first and second levels N1, N2, forms the probe contact 37.

The length of the pipe 34 in the area of the probe contact 37 can be implemented in other ways. For example, in an alternative embodiment, the lance-type section 36 is formed exclusively by the conductive path 39 and possibly by the insulation layers 40. Common to all embodiments, however, is the fact that the probe contact 37 ends at a level below the open end 35.1 of the pipe 34.

Figure 9:
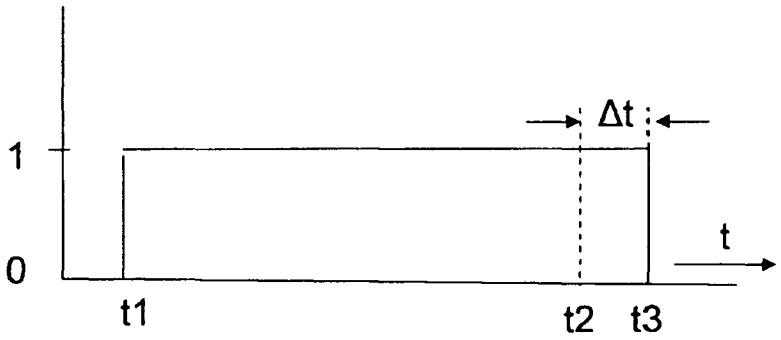
FIG. 9 is a time chart showing the opening and closing of the liquid valve of the filling machine of FIG. 1.

FIG. 9 shows the opening and closing of a liquid valve 14 as a function of time between the start and end of a filling phase when using the probe 16*a*. In FIG. 9, the open state of the liquid valve 14 is labeled with "1" and the closed state with "0."

The containers 2 to be filled are again supplied by an external transporter and, in each case, reach a filling position 4*a*, 4*b* individually through a container inlet 1.1. The filled containers 2 are removed from the filling positions on a container outlet 1.2. At an angular area of the rotor's rotary movement, between the container inlet 1.1 and the container outlet 1.2, the containers 2 are pre-treated. Such pre-treatment can include purging and/or pre-tensioning the container 2 with an inert gas, preferably with $CO_2$ gas while the container 2 is arranged in a sealed position against the particular treatment block 5, 5*a* or 5*b*. In the actual filling phase, the containers 2 are filled with the filling material.

The filling phase starts at time t1 or when the relevant filling position 4*a*, 4*b* or one of these two filling positions of a treatment block 5, 5*a* or 5*b* has reached the angular position W1, shown in FIG. 1. Filling occurs by opening the liquid valve 14. Once the filling material level of the filling material inside the container during filling rises to the level N2, the probe contact 37 trips. This occurs either when the container 2 reaches the angular position W2, as shown in FIG. 1, or at time t2, as shown in FIG. 9. A timer function is then activated. At time t3, after a time delay Δt, the liquid valve 14 closes. The time delay Δt is set so that the filling material level in the container 2 is at the target level N1 after the closing of the liquid valve 14.

While the angular position W1 at which the filling phase is started by opening the particular liquid valve 14, is fixed for example, the angular positions W2 and W3 are dependent inter alia on the speed of rotation of the rotor 3. The time delay Δt is independent of the speed of rotor 3. This is calculated, for example, from the previous fill cycles and/or attempts and is, for example, saved and retrievable as a process parameter typical for the particular kind of filling material and the particular type and/or size of the containers 2, in a computer that controls the filling machine 1.

The design of the probe 16*a* avoids not only the aforesaid disadvantages of conventional gas-return pipes, but promotes increased reliability with a simplified mechanical structure and reduced fabrication and/or assembly costs. This increase in reliability arises because, in the event of any failure of the probe contact 37 and/or the associated electronics, the length of pipe 34 continues to be available to act as both a gas-return pipe and as an element that restricts the fill depth. It does so by causing formation of a gas barrier inside the container's head space. This gas barrier halts further entry of liquid.

The pipe 34 also preferably has further functions. For example, a pre-treatment of the containers 2 in at least one pre-treatment phase preceding the actual filling phase. Thus, the pipe 34 serves, for example, for purging and/or pre-tensioning the inside of the container with an inert gas, e.g. $CO_2$ gas etc.

In the illustrated embodiment, the lower open end 35.1 of the pipe 34 has a lateral recess 41. This lateral recess 41 permits the headspace to be purged with an inert gas after the container has been filled even if the fill level is slightly above the level of the open end 35.1.

It is also possible to provide a multiplicity of probe contacts 37, this being once again preferably such that at least one probe contact 37 is at a distance below the open end 35.1 of the gas-return channel 35. With at least two probe contacts 37 that are spaced apart from each other at least in the direction of the filler element axis FA, there arises the possibility, at the tripping of the probe contact 37 that is at the greatest axial distance from the open end 35.1, that the relevant filling position 4*a*, 4*b* is tripped from a "fast filling" mode to a "slow filling" mode and only upon tripping the other probe contact 37 is the timer function for the time-delayed closing of the associated liquid valve 14 activated.

Moreover, it is also possible to start the closing of the particular liquid valve 14 without delay, if the corresponding probe contact 37 trips.

The invention was described above using an example of an embodiment. It is clear that numerous modifications and variations are possible without thereby departing from the inventive idea underlying the invention.

Although only a filling machine 1 has been described, the principles set forth herein are applicable to other kinds of container-treatment machines, and in particular, rotating container-treatment machines. Examples include cleaning or sterilizing machines.

Especially with a design of the container-treating machine 1 for cleaning and/or sterilizing the containers 2, there is the possibility of providing all the functional elements of the, in each case, at least two container-treatment stations 4*a*, 4*b* combined to form a group or a treatment block 5 just once jointly for all the treatment positions of each treatment block 5, wherein the functional elements are, in particular, the functional elements for the positioning and/or centering and/or moving of the containers and the functional elements for the control of liquid and/or gas and/or vapor paths and also the functional elements for monitoring and/or controlling the particular treatment process, such as sensors or measuring elements or measuring systems and/or their actuating drives. Of course, instead of using the fill-depth probes illustrated, it is possible to capture the fill quantity or depth in the multiple filling point by means of at least one separate MID assigned to one of the two bottles, one gas-return pipe or another measuring system.

The invention claimed is:

1. An apparatus comprising a filling machine for filling containers with filling material, said filling machine comprising a rotor and treatment blocks provided on said rotor, wherein each treatment block comprises a liquid channel, a liquid valve on said liquid channel, a filling-material dispensing opening, functional elements for controlling a container-treatment procedure, wherein said functional elements comprise at least one of: a functional element for controlling actuation, a functional element for controlling relative movement between said treatment block and said containers, or a functional element for controlling fluid paths for a treatment medium, treatment positions, each of which is configured to carry out said container-treatment procedure on one of said containers, said container being one that is arranged at said treatment position, wherein all of said treatment positions share one of said functional elements, and wherein each of said treatment positions further comprises a measuring system comprising a probe, said measuring system determining either depth or volume of filling material in a container, said treatment block further comprising a pressure sensor for monitoring said container-treatment procedure.

2. The apparatus of claim 1, wherein all treatment positions of said treatment block and at least one of said functional elements form a common assembly that can be removed from said rotor as a unit and inserted into said rotor as a unit.

3. The apparatus of claim 1, wherein said functional element for controlling said relative movement comprises a container carrier and a lifting element that cooperates to control movement of containers relative to said treatment block and wherein said container carrier and said lifting element are controlled independently of container carriers and lifting elements for other treatment blocks.

4. The apparatus of claim 1, wherein said functional element for controlling said relative movement comprises a container carrier and a lifting element that cooperate to cause relative movement between said treatment block and said containers.

5. The apparatus of claim 1, wherein said treatment block further comprises a control valve, said control valve being arranged in a gas channel formed in said treatment block, said control valve being shared by all treatment positions of said treatment block.

6. The apparatus of claim 1, wherein said treatment block further comprises a control valve and a gas channel having said control valve arranged therein, said control valve being shared by all treatment positions of said treatment block.

7. The apparatus of claim 1, wherein said treatment block comprises liquid channels formed therein, gas channels formed therein, and control valves arranged in said gas channels, wherein said liquid channels, said gas channels, and said control valves are shared by all treatment positions in said treatment block.

8. The apparatus of claim 1, further comprising controlled gas-paths formed in said treatment block, wherein said controlled gas-paths are shared by all treatment positions of said treatment block.

9. The apparatus of claim 1, further comprising separate controlled gas-paths for each treatment position in said treatment block, wherein said controlled gas-paths are jointly controllable.

10. The apparatus of claim 1, wherein said measuring system comprises, at each treatment position, an axially-adjustable probe and a piston-cylinder arrangement, wherein said probe is configured to determine a fill depth of said filling material in a corresponding container, and wherein said piston-cylinder arrangement jointly adjusts heights for all probes of all treatment positions of said treatment block.

11. The apparatus of claim 1, further comprising centering bells that are movable synchronously with said rotor, wherein each centering bell corresponds to a treatment position, and wherein said centering bells are controllable independently of each other.

12. The apparatus of claim 1, wherein said measuring system comprises, at each treatment position, an axially-adjustable gas-return pipe and an electrical contact, wherein said gas-return pipe forms a gas-return channel, and wherein said electrical contact is arranged outside said gas-return channel and at a distance from an open lower end of said gas-return channel.

13. The apparatus of claim 1, wherein each treatment position comprises a centering bell for centering containers, wherein said centering bells can be raised and lowered individually along a direction parallel to a filling-element axis of filling elements in said treatment block.

14. The apparatus of claim 1, wherein each treatment position of said treatment block comprises a centering bell for centering a container at said treatment position, wherein said centering bell is movable along a filler-element axis, wherein said centering bells move jointly.

15. The apparatus of claim 1, wherein said pressure sensor is common to all treatment positions of a treatment block.

16. The apparatus of claim 1, wherein said treatment block comprises gas paths, pneumatically-actuated valves that control said gas paths, electrically-actuated pneumatic valves, and control lines that connect said pneumatically-actuated valves to said electrically-actuated valves.

17. The apparatus of claim 1, further comprising a common pneumatic valve, a control line, a first set of control valves assigned to a first treatment position of said treatment block, and a second set of control valves assigned to a second treatment position of said treatment block, wherein each control valve in said first set has a corresponding control valve in said second set, wherein each control valve in said first set and said corresponding control valve thereof in said second set are connected to said common pneumatic valve by said control line.

18. The apparatus of claim 1, wherein said functional element for controlling fluid paths for a treatment medium is configured to receive a sterilizing medium and wherein said functional element for controlling actuation, said functional element for controlling relative movement between said treatment block and said containers, and said functional element for controlling fluid paths for a treatment medium shared by all treatment positions of said treatment block.

* * * * *